US005197547A

United States Patent [19]

Morgan

[11] Patent Number: 5,197,547

[45] Date of Patent: Mar. 30, 1993

[54] WIRELINE SET PACKER TOOL ARRANGEMENT

[76] Inventor: Allen B. Morgan, Box 1708, Jena, La. 71342

[21] Appl. No.: 884,955

[22] Filed: May 18, 1992

[51] Int. Cl.[5] ..... E21B 33/12

[52] U.S. Cl. ..... 166/387; 166/181

[58] Field of Search ..... 166/387, 386, 123, 124, 166/125, 181, 182

[56] References Cited

U.S. PATENT DOCUMENTS

| | | | |
|---|---|---|---|
| 4,593,765 | 7/1986 | Greenlee | 166/387 |
| 4,648,445 | 3/1987 | Caskey | 166/123 X |
| 4,648,446 | 3/1987 | Fore et al. | 166/123 |
| 4,693,309 | 9/1987 | Caskey | 166/123 |
| 4,750,564 | 6/1988 | Pettigren et al. | 166/123 X |
| 5,048,613 | 9/1991 | Shilling | 166/123 X |

OTHER PUBLICATIONS

1986 XL-W Retrievable Seal Bore Packer.
1984 Arrowset I Production Packer.
Arrowset I-X Production Packer (1986).
Arrowset Pump Out Plug (Date unknown).
Type T On/Off Tool (Date unknown).

*Primary Examiner*—Terry Lee Melius
*Attorney, Agent, or Firm*—Jack W. Hayden

[57] ABSTRACT

A body (B) having a collapsed resilient element (55) therein is releasably secured on a mandrel (M). A packer (P) is supported on a packer support (26) on the mandrel. As the packer tool is assembled, opposed lugs on the mandrrel are placed in a J slot (54) of a member (25) so the packer is capable of being set by a wireline pressure setting assembly (W) when the packer tool is positioned in the opening in a tubular member or in open hole in a well bore without requiring further manipulation of the packer tool. A J slot on the member (25) cooperates with the lugs on the mandrel (M) in setting the packer tool, in releasing the packer tool and in enabling the packer tool to be readily converted for setting by a well string if desired as well as enabling the packer tool to function in many applications such as, but not limited to use as a bridge plug, production packer, test packer, treating packer, multiple string packer, seal bore packer and compression or tension well string anchor.

19 Claims, 8 Drawing Sheets

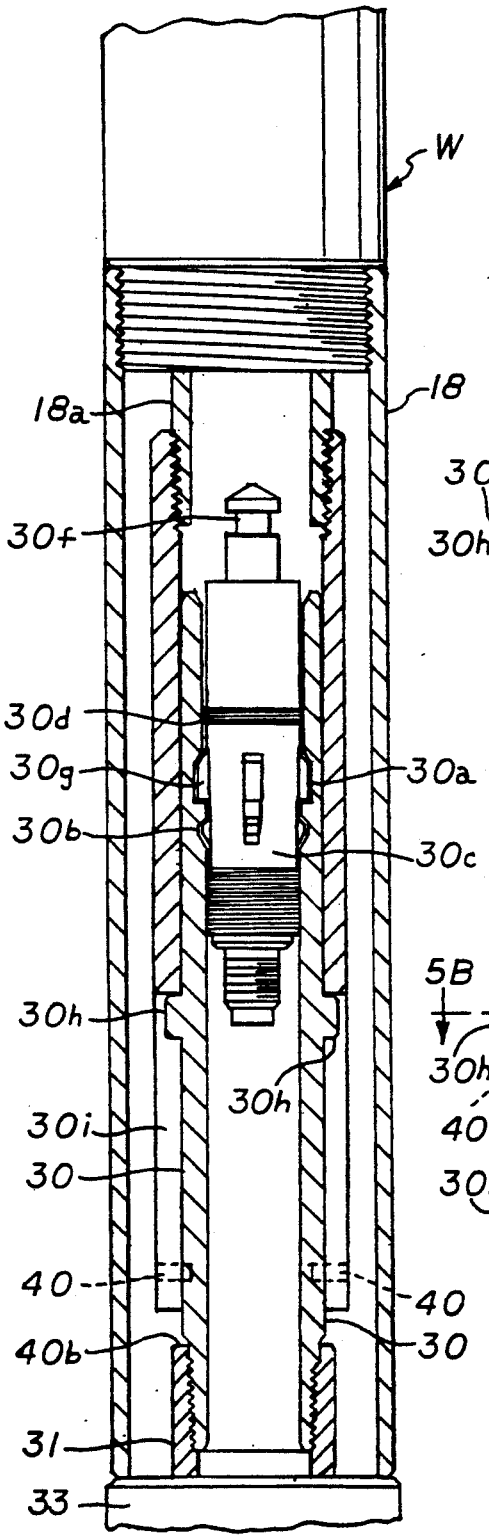
FIG.5
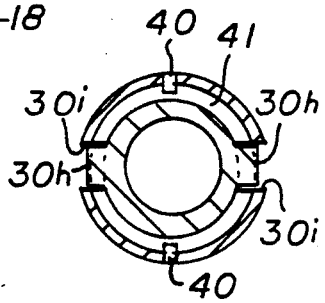
FIG.5B
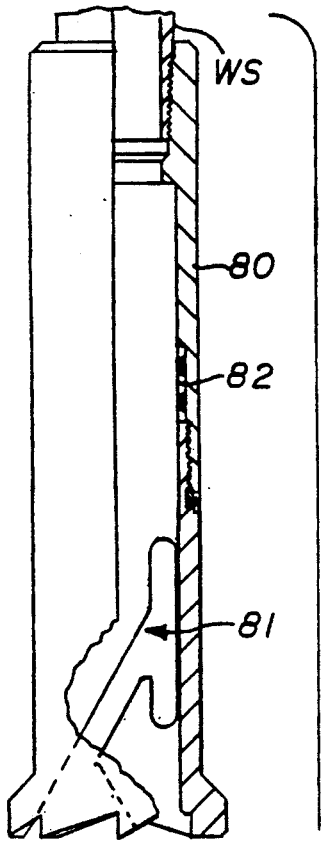
FIG.6
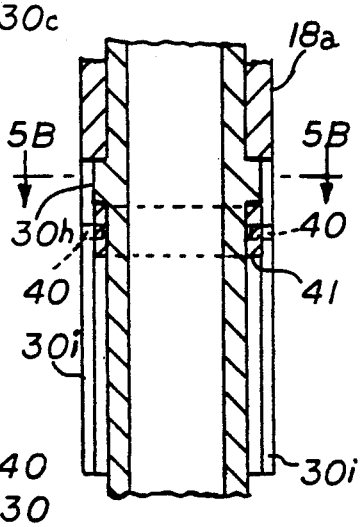
FIG.5A
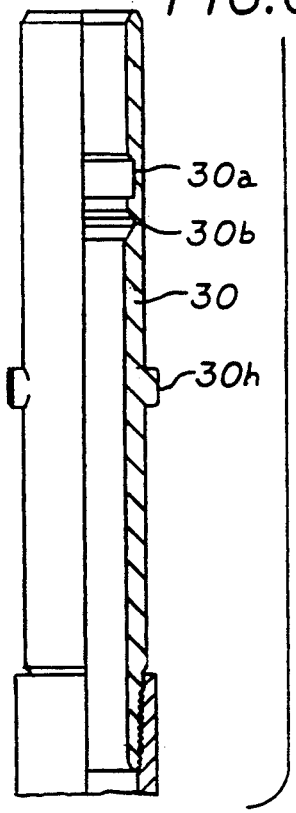

WIRELINE SET PACKER TOOL ARRANGEMENT

STATEMENT OF THE PRIOR ART

There are various types of packers which are lowered into and set in a well bore either in a tubular member or in open hole by a well string such as a tubing or by a wireline pressure setting assembly, for various types of operations. A tubing set packer is provided with a J slot to enable the packer to be set. The tubing can remain releasably connected by a stinger connected to the packer and the well can be flowed through the packer to the tubing, or treated through the tubing and packer. The tubing string and packer can then be retrieved when desired.

Generally, all packer tools have packers, or seal elements, a packer support, and an arrangement to effect setting of the packer, along with an anchor assembly to assist in retaining the packer in set position in an opening.

However, present wireline set packer tools with which applicant is familiar require at least two and sometimes more trips with the well string into and out of the well bore to position and then retrieve the packer and auxiliary equipment associated therewith. For example, where a wireline set packer is to receive a seal bore assembly for production through the packer from a formation below the packer and/or for flow through the packer to carry out treatment operations in the well bore below the set packer such as, by way of example only and not by limitation, acidizing, formation fracturing, squeeze cementing, or any other desired operations in the well bore, so far as known to applicant, present wireline packer and tool arrangements require a plurality of trips by the well string to set the packer, return to the earth's surface to attach the auxiliary equipment such as a seal bore assembly, to the well string and position the seal bore assembly with the packer. When the packer is to be retrieved, then the seal bore assembly is retrieved and then the well string is relowered into the well bore to retrieve the packer to the earth's surface.

Ordinarily a workover rig is employed in conducting these operations to lower, set the packer and then retrieve the well string to the earth's surface and then lower the well string with the auxiliary equipment and position the auxiliary equipment to be used with the packer. Similiarly, the auxiliary equipment is first retrieved to the earth's surface by the well string and then a second trip is necessary to retrieve the wireline set packer.

Also, in conducting flow tests or treating in multiple isloated zones in a well, longitudinally spaced packers on the well string are usually both set and then released and reset and released at each zone which is tested or treated. Malfunction of either one of the packers during this operation may cause serious problems.

Any delay due to problems may involve substantial expense. Retrieval of the wireline set packers is accomplished, generally, by a well string which presently requires a workover rig on the location and a work crew which can be costly and time consuming which may not be economically feasible in all similarly.

Applicant is not aware of any packer set by a well string setting tool which can be readily converted to be run and set by a wireline setting tool.

Some packers are provided with shear means to enable release and retrieval of the packer, generally by a well string, but if the well pressure exceeds the strength of such shear means, the packer may be prematurely unset causing problems. Also use of a wire cable to retrieve a packer may cause problems, if there is a malfunction and the packer is not released by the wire cable. In some circumstances, a fishing operation may be necessary to remove the wire cable and the packer which can be an expensive operation.

SUMMARY OF THE INVENTION

One object of the present invention is to provide a wireline set packer tool arrangement including a retriever that overcomes the above problems.

A further object of the invention is to provide a wireline set packer which can be positioned in a tubular member or well bore opening and set without further tool manipulation when it is positioned in the opening.

Another object of this invention is to reduce the cost in connection with the use of packers and related equipment in well bore operations.

A further object of the present invention is to provide a wireline set packer arrangement which simplifies and reduces the time and cost of employing packers to test or treat formations in a well.

Another object of the present invention is to provide a wireline pressure operated packer arrangement and tool which can be readily adapted in the field to be run with a well string as may be necessary.

Another object is to provide a universal wireline set packer arrangement that can be run and employed as a production packer, test packer, seal bore packer, and/or bridge plug.

A still further object is to provide a packer that can be readily converted in the field from one type of packer to another as conditions may warrant.

Yet a further object is to provide a wireline set packer arrangement including a retriever that can recover the packer and associated equipment from the well bore in a minimum number of trips and preferably in a single trip.

Another object is to provide a wireline packer arrangement including a retriever and a washover that can be employed to clear dirt and debris away from the packer and recover the packer and associated equipment from the well bore in a single trip.

A further object of the invention is to provide a wireline packer arrangement and method for stepwise isolating a plurality of zones as desired in a well bore in a single trip into and out of the well bore to set a plurality of wireline set packers and recovering a plurality of wireline set packers in a single trip into and out of the well bore either in cased or open hole.

Still another object is to provide a surface arrangement in a wireline set packer tool having a mandrel which surface arrangement cooperates without further tool manipulation to set the packer when the packer tool is in position and maintain it in set position and an additional surface arrangement to release the packer from set position merely by manipulating the mandrel.

BRIEF DESCRIPTION OF THE DRAWINGS

FIG. 5 is a one half sectional view showing a retrievable plug for use adjacent the upper end of the upper portion of the mandrel of the tool and a form of releasable connection between the mandrel and the wireline pressure setting assembly;

FIG. 5A shows an alternate form of the releasable connection of FIG. 5

FIG. 5B is a sectional view on the line 5B—5B of FIG. 5A;

FIG. 6, upper view, is a one quarter sectional view of a form of a washover for connection with the lower end of the mandrel as schematically shown in FIG. 11. or with a well string as a retriever for the tool part of the present invention. The lower part of FIG. 6 shows a stinger which may be selectively connected with the upper end of the mandrel, as illustrated in FIGS. 1A and 11, respectively and may be connected with the lower end of the mandrel to depend therefrom;

DESCRIPTION OF THE PREFERRED EMBODIMENTS

Two forms of the device of the present invention will be described in detail in connection with its use with as a bridge plug in well bore operations. However, such explanation is by way of example only and is not intended as a limitation, since the present invention may be used in various applications.

Figure 1A:
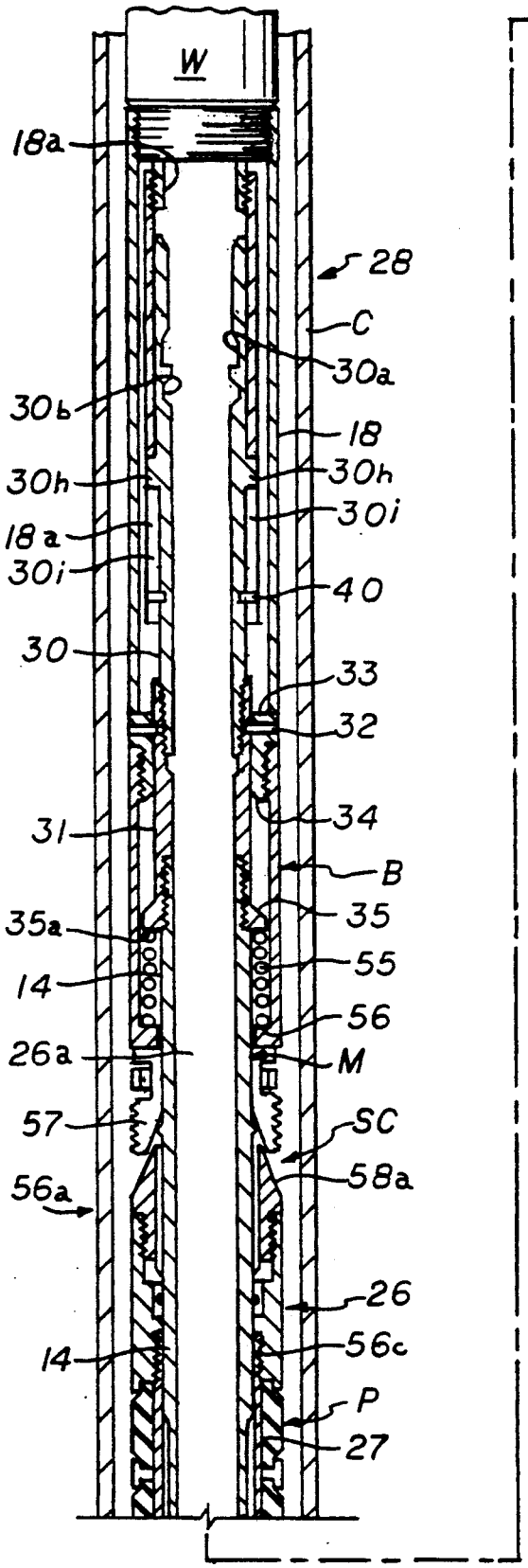
FIGS. 1A and 1B are one half continuation sectional views of the upper portion and lower portion, respectively, of one form of the tool part of the present invention showing the arrangement in running in position with a releasable connection between the mandrel and a body that responds to actuation of the wireline pressure setting assembly and with a plug adjacent the lower end of the mandrel.
Figure 1B:
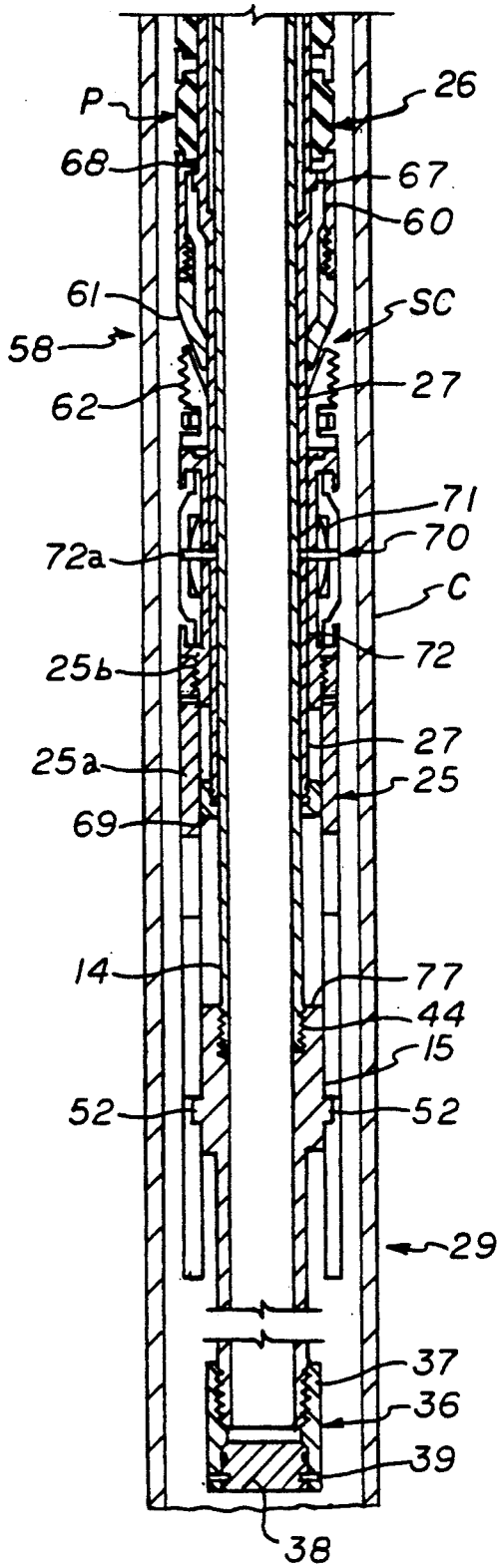

Attention is first directed to FIGS. 1A and 1B of the drawings wherein a casing C is shown in the general position it would assume when in a well bore, not shown. A wireline pressure setting assembly is schematically represented at W and is releasably connected to the upper tool portion shown in FIG. 1A in any suitable, manner as will described hereinafter. Several forms of the wireline pressure setting assembly W are manufactured and have been available and used for a number of years to, among other things, set packers lowered into a well bore on a wireline. Such devices are available from Baker Oil Tools, Inc. and the use and manner of operation of a wireline pressure setting assembly is well known to those skilled in the art and no detailed explanation of its structure or operation is deemed necessary. It includes an outer sleeve 18 whose lower end is adjacent body B as shown in the drawings. When actuated, assembly W functions to move sleeve 18 down to cause force transmitting apparatus including the body referred to generally at B with collapsed resilient element 55 therein which is releasably secured on the mandrel referred to generally at M, member referred to generally at 25, packer support generally referred to at 26 including a support sleeve 27 and upper and lower slip and cone assemblies SC to cooperate to extend or move the packer or seal elements referred to generally at P along with the upper and lower slip and cone anchor assemblies referred to generally at SC into sealing and securing relation, respectively, with the opening defined by the inner surface or wall of the casing C without further manipulation of the tool in a manner as will be described in detail hereinafter.

The tool portion of the invention includes the mandrel M which has a longitudinal bore 26*a* therethrough, an upper end portion referred to generally at 28 and a lower end portion referred to generally at 29. The mandrel may be considered as including a tubular element referred to as a stinger 30 which is threadedly connected to the mandrel sub 31 as shown in the drawings. The mandrel sub 31 is telescopically received through the upper end of Body B and the Body B is releasably connected to the mandrel M by suitable frangible means such as shear pins 32 which are illustrated as extending through body B and into sub 31. An annular cap 33 is threadedly engaged in the upper end of Body B and the cap terminates in the shoulder 34 internally of Body B as shown. Mandrel sub 31 has shoulder 35 extending outwardly between mandrel sub 31 and body B which engages shoulder 34 when the packer is being unset so that mandrel sub 31 may be moved up by the tubing string connected by washover 80 to the stinger 30, as will be described.

In the tool form part of the invention shown in FIGS. 1A and 1B, a pump out plug referred to generally at 36 is shown adjacent the lower end of the mandrel M which includes a tubular housing 37 threadedly connected to the mandrel, and a plug portion 38 releasably secured in the housing by any suitable means such as a frangible member, or shear pin 39. After the packer is set, pressure can be applied to the bore of the mandrel to shear the pin 39 for releasing the plug and communicating through the mandrel bore 26*a* and packer P as desired.

Where it is desired to provide a plug in the mandrel bore 26*a* above the set packer adjacent the upper end 28 of mandrel M, the retrievable plug 30*c*, shown in FIG. 5, with external seals 30*d* thereon may be employed. This type plug, its construction and use are well known in the art. It includes a fishing element 30*f* at its upper end for engagement with a fishing tool connected and lowered and positioned or retrieved by tubing or a slick line. It is seated by engaging members 30*g* in annular profiles, or recesses 30*a*, 30*b* formed in the stinger 30 in a manner well known in the art and as shown in FIG. 5 of the drawings.

FIGS. 1A and 5 also illustrate one manner of releasably connecting the wire line pressure setting assembly W with the tool portion of the present invention. The assembly W includes an outer sleeve 18 that moves down when the assembly W is actuated in a manner well known to those skilled in the art. The stinger 30 at the upper end of mandrel M is connected to an inner sleeve 18*a* of the assembly W as shown in FIGS. 1A and 5 and the lugs 30*h* on stinger 30 are positioned at the ends of longitudinal slots 30*i* extending in the inner sleeve 18*a* to the lower end there of as shown. Shear pins 40 extend through sleeve 18*a* and into stinger 30 as shown, and when these shear pins shear, assembly W is released from the tool part of the present invention after the packer P of the present invention has been set in the tubular member, as will be described. Any suitable well known manner of connecting the present invention to assembly W may be employed.

FIGS. 5A and 5B show an alternate form of the releasable connection shown in FIG. 5. A ring 41 is positioned underneath the lugs 30*h* and shear pins 40 extend through sleeve 18*a* and into the ring 41. When the shear pins 40 are sheared, the assembly W is released and the ring falls to rest on shoulder 40*b*.

Figure 4:
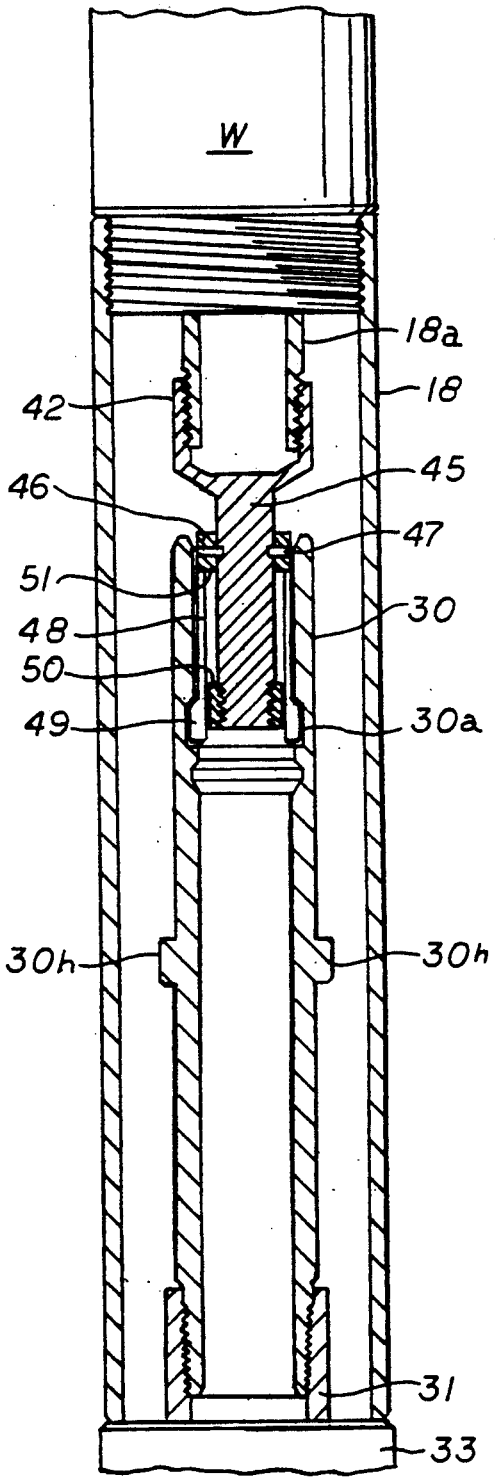
FIG. 4 illustrates one arrangement for releasably securing the part of the invention of FIGS. 1A and 1B to a wireline pressure setting assembly.

In FIG. 4 a collet form of release connection between the assembly W and stinger 30 is shown. The outer sleeve 18 and inner sleeve 18*a* are again shown. A coupling 42 is connected to inner sleeve 18*a* with element 45 extending therefrom and into stinger 30 as shown. A ring 46 is connected by shear pins 47 to element 45 and ring 46 has circumferentially spaced fingers 48 which depend from ring 46 and extend into stinger 30 with enlargements 49 at the ends of the fingers which fit in the annular profile, or recess 30*a* on the stinger 30 as shown in the drawings, and are retained in position in the profile by the element 45. When the shear pins 47 are sheared by the assembly W as described with regard to FIG. 5, the assembly W pulls the element 45 upwardly and the lower shoulder 50 on the element 45 engages shoulder 51 on the lower surface of ring 46 and continued upward movement of element 45 disengages the enlargements 49 from the profile and releases the assembly W from the tool part of the present invention.

Figure 2:
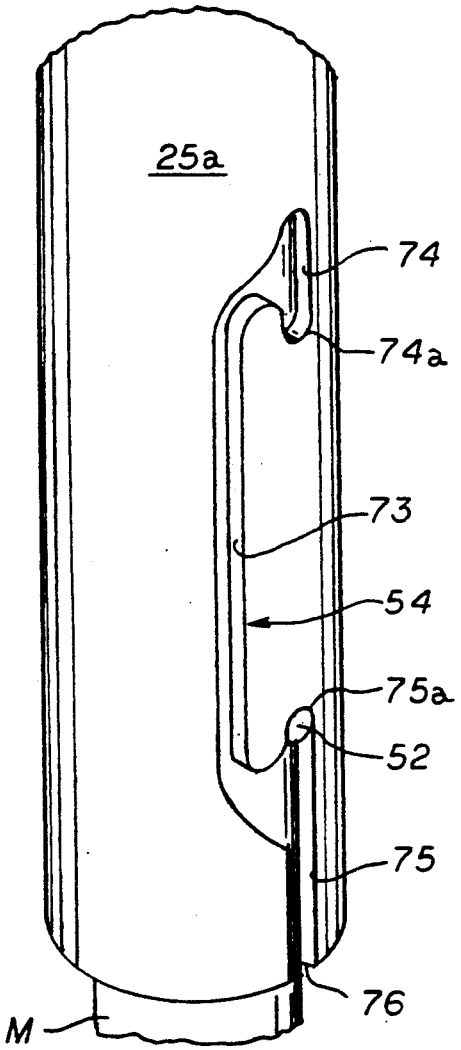
FIG. 2 is an enlarged partial plan view of the lower end of FIG. 1B.
Figures 3A, 3B:
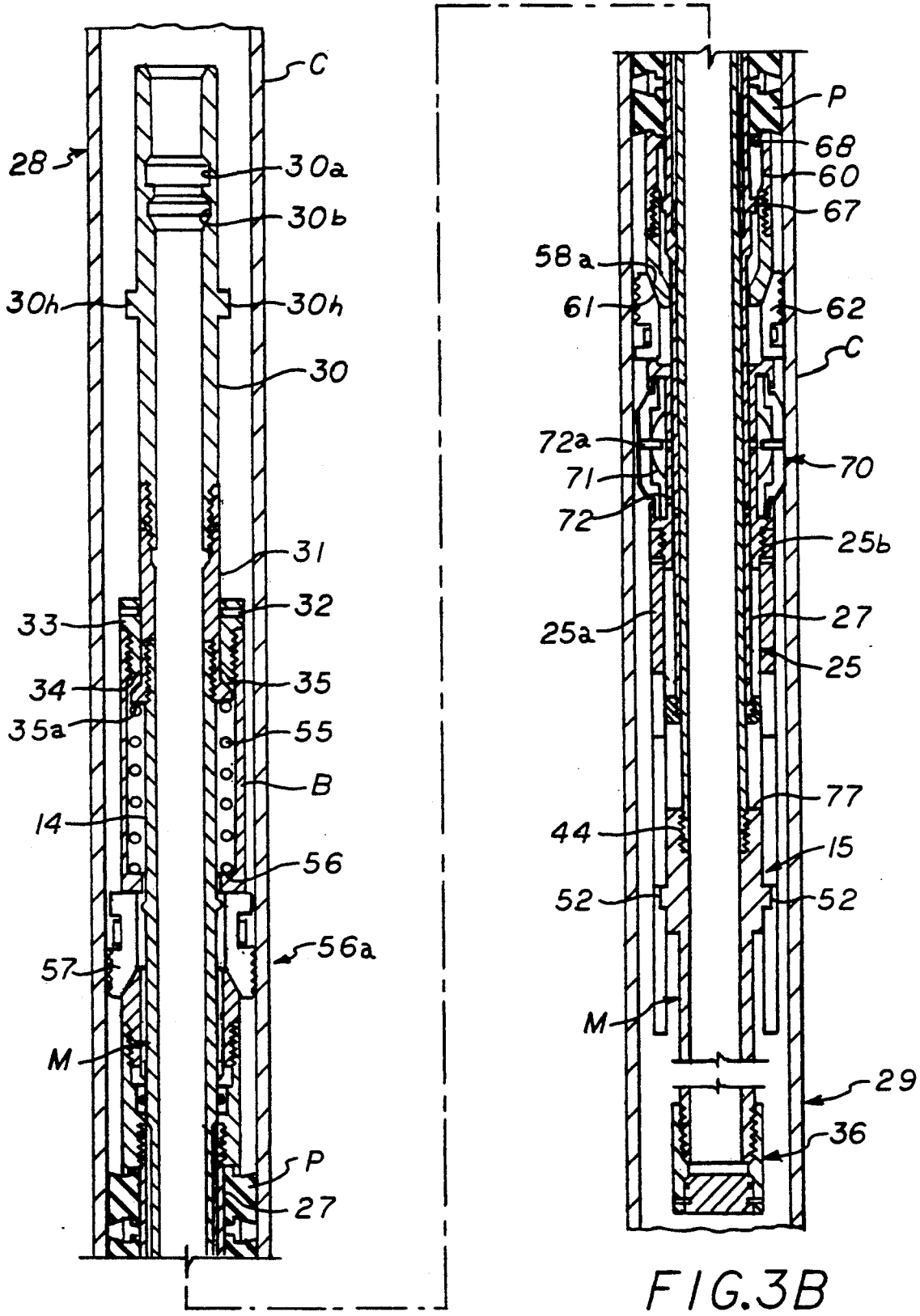
FIGS. 3A and 3B are one half sectional views similar to FIGS. 1A and 1B showing the components in set position.

The mandrel M is formed of any suitable number of tubular portions, other than stinger 30 and mandrel sub 31 which are threadedly connected together and the drawings, by way of example only, show it formed of upper tubular portion or sub 14 and lower tubular portion 15 threadedly connected together by cooperating threads on mandrel portions 14 and 15 as represented at 44 in FIGS. 1B and 3B of the drawings. A shoulder 77 is provided on lower mandrel portion 15. The mandrel M has diametrically opposed lug means or projections 52 on the outer annular surface of tubular portion 15 as shown in FIGS. 1B and 3B and better seen in FIG. 2. In one manner of assembly, the lugs 52 are positioned in the J slot referred to generally by the numeral 54 in the member 25 as the tool is assembled to engage or be positioned adjacent a shoulder in the J slot, as will be described and enable the upper and lower tubular portions 14 and 15 to be connected together and then the lugs are shifted, or positioned in the J slot to preferably engage another shoulder surface in the J slot to hold the partially surrounding member 25 on the mandrel M in a manner so that when the tool portion of the invention is positioned in an opening, such as the opening in a casing C, the tool can be actuated by the assembly W for sealing the packer P in the opening without further manipulation of the tool. In another manner of assembly, the lugs 52 are initially positioned preferably in engagement with a shoulder surface in the lower slot portion to enable the packer tool to function as above described.

Figure 7:
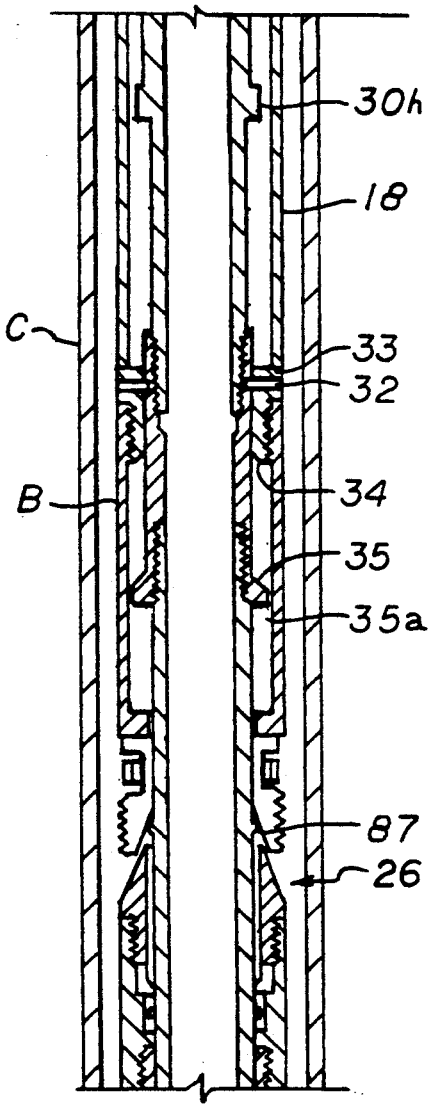
FIG. 7 is a one-half sectional view of part of the upper tool portion and illustrating a form of the present invention without the resilient element.
Figure 8:
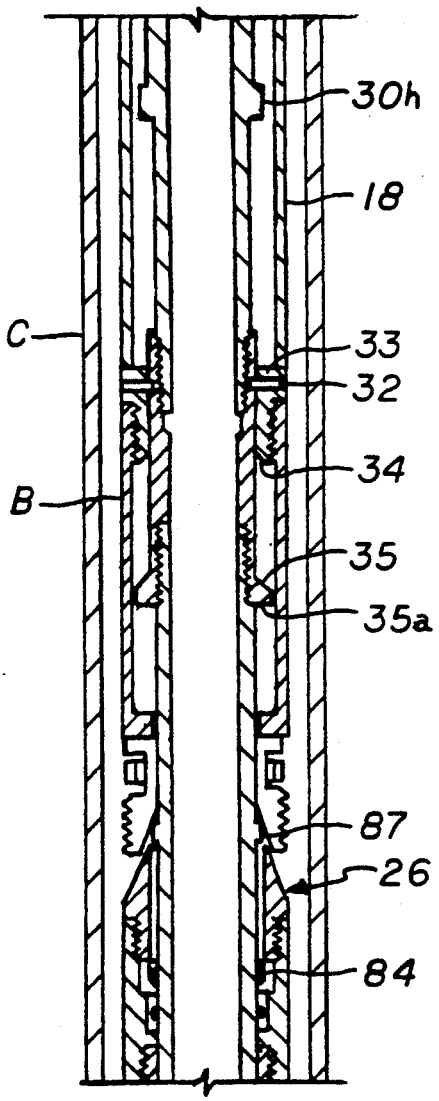
FIG. 8 is a one-half sectional view of part of the upper tool portion similar to FIG .7 and illustrating yet another embodiment with a friction resistant bearing.

As shown in FIG. 1A, the hollow spring cage housing or body B is releasably secured to the mandrel M adjacent the connection of the stinger 30. The shear pins 32 are shown extending through cap 33 and into mandrel sub 31, but the location may be changed as desired or necessary. In the FIG. 1A form, the longitudinal body B is hollow and a resilient element 55, such as a coil spring or other type resilient element is positioned therein between the annular shoulder 56 at the lower end of body B and the shoulder 35*a* formed on the mandrel by the end of the mandrel sub 31 as shown in FIG. 1A. The spring 55 is collapsed when the tool is assembled as the body B is moved up on the mandrel M to be secured to the mandrel by the frangible means 32. It remains collapsed, or partially collapsed as the body B is moved down along the mandrel M by the outer sleeve 18 as will be described and may assist in maintaining the packer in set position. FIGS. 7 and 8 show an alternate form of the body B which does not have a resilient member therein and the body B is again releasably secured to the mandrel M by shear pins 32.

First cooperating means are provided adjacent a first or upper end portion, generally referred to at 56*a* of packer support 26 and on the adjacent end of body B and second cooperating means are provided adjacent a second or lower end portion generally referred to at 58 of the packer support 26 and the adjacent end of member 25 which first and second cooperating means engage with the surface defining the opening in the tubular member or open hole in the well bore to secure the packer in sealing relation with the surface defining the opening in a tubular member as shown in FIG. 3B. The first cooperating means include slips 57 supported at the lower end of the body B in a manner well known to those skilled in the art and are adjacent, and preferably not in contact with the annular, tapered surface 58*a* forming a conical surface or cones supported on the first end portion 56*a* of the packer support referred to generally at 26, in any suitable manner well known in the art.

The second cooperating means includes a movable end portion 60 on the second or lower end of packer support 26, which end portion has an annular tapered surface 61 forming a conical surface or cones for engagement with the adjacent slips 62 on member 25 when the assembly W is actuated. It can be appreciated that the relationship of the cones and slips may be reversed or altered within design limits.

The first end portion 56*a* of packer support 26 is secured by suitable means such as threads 56*c* to support sleeve 27 as shown in FIG. 1A. on which packers, or seal elements, P are supported for movement. Second movable end portion 60 of packer support 26 is movable relative to support sleeve 27 and packer support 26 to expand or extend packer P into sealing engagement with the surface defining the opening. An annular shoulder 67 on support sleeve 27 engages inwardly extending shoulder 68 on the movable end portion 60 and supports the movable end portion on packer support 26 while accommodating movement of such end portion 60 when the assembly W is actuated to cause forces to act on the tool components in a manner to compress the packer P and extend it and the slip and cone arrangements SC into sealing and securing relation within the opening as will be described hereinafter.

The support sleeve 27 extends longitudinally of the mandrel as shown in the drawings and terminates in end cap 69 which may be threadedly engaged thereon and assists in supporting the partially surrounding member 25 on the sleeve 27. The member 25 may be formed of any desired number of tubular subs or portions, and in the FIGS. 1A and 11 form includes an upper tubular sub 72 and a lower tubular sub 25a as shown in the drawings which are threaded as shown at 25b or otherwise connected together as the tool is assembled. The lugs 52 on the lower mandrel portion 15 are placed in the J slot to secure the partially surrounding member 25 to the mandrel for actuation of the tool by the assembly W when positioned in the opening without any further manipulation of the tool.

Figure 9:
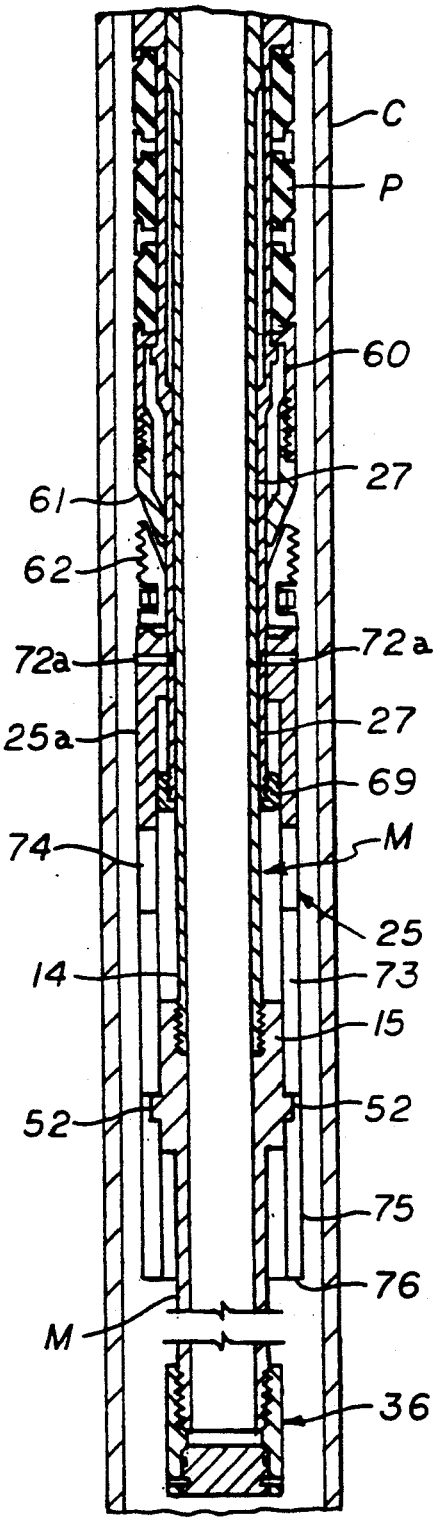
FIG. 9 is a one half sectional view of an alternate form of the lower portion of part of the present invention which omits the drag blocks.

In FIG. 1A drag blocks referred to generally at 70 and springs 71 are supported in the tubular sub 72. Member 25, in one form of the invention, is formed by the upper tubular sub or member 72 and the lower tubular sub or member 25a which are connected together to form the member 25 in the FIGS. 1A, 1B, 3A, and 3B form of the invention. When the drag blocks are used, they are are urged outwardly by spring means 71 for engagement with the casing C to enable the mandrel M to be manipulated relative to the member 25 to reset the packers, if desired, at a different elevation in the well bore in a manner well known in the art. When the drag blocks are omitted, the tubular sub or member 72 is omitted and member 25 comprises the tubular sub 25a, as shown in FIG. 9. In such event the slips 72 may be supported on the end of tubular member 25a as shown in FIG. 9. The shear pins 72a as shown in FIG. 9 extend through member 25a and into support sleeve 27 to secure support sleeve 27 in position as the tool is lowered in the well bore.

In normal use of the present invention, the springs 71 will be collapsed and secured to the support sleeve 27 and member 25 as shown in FIG. 1B by suitable means such as the shear pins 72a to maintain them inoperative. Shear pins 72a in all forms of the invention also secure the member 25 so slips 62 are supported in non engaging position adjacent the tapered surface 61 as the tool is lowered in the well bore.

In assembly of the FIG. 1A and 1B form of the present invention, all of the components, except lower mandrel tubular portion 15, are assembled in any well known manner by any person skilled in the art on the upper mandrel portion 14 in any desired order that positions them to function properly as represented in FIGS. 1A, 1B, 7, 8, or 9.

One manner of assembly is where mandrel sub 31 and cap 33 are assembled in a well known manner on body B, preferably with the resilient element 55 therein, and body B is then releasably secured to the mandrel M by any suitable frangible means well known in the art such as shear pins 32. Body B may be employed in some circumstances without the element 55. Where this manner of assembly is employed, the other packer tool components, with the exception of lower mandrel portion 15, may be manually moved along on mandrel M toward the body B.

The J slots in the lower portion 25a of member 25 are diametrically opposed and the J slots may be termed double J slots in that each includes a longitudinal slot portion 73 that communicates with upper slot portion 74 and lower slot portion 75 in partially surrounding member 25 which upper and lower slot portions are offset circumferentially relative to the main slot portion 73, as shown in the drawings. Lower slot portion 75 extends to the lower end of member 25 thus providing an open end 76 in the lower slot portion 75 for entry access by the lug means 52 to the lower slot portion 75 of J slot means.

The lower mandrel portion 15 with opposed lugs 52 thereon is then positioned so the lugs go into slot open end 76 and the lugs are positioned adjacent or engaged with a shoulder 75a in the lower slot portion 75. Mandrel lower tubular portion 15 is then rotated along with partially surrounding member 25 to threadedly engage lower mandrel portion 15 with upper mandrel portion 14 by means of the cooperating threads represented at 44 on the mandrel portions 14 and 15.

The positioning of lugs 52 adjacent or engaged with slot shoulder or surface 75a on member 25 places all components of the tool part of the invention in position to cooperate for setting of the packer when the packer is placed in the opening in which the packer is to be set without further tool manipulation.

Where the tool components, except the lower tubular mandrel portion 15, are assembled on the mandrel and the body B is not yet releasably secured to the mandrel the lugs 52 on the lower mandrel portion 15 are aligned with the open end 76 of lower slot portion 75 and relative longitudinal movement between the lower mandrel portion 15 and member lower tubular sub 25a of member 25 is effected so that the lugs 52 travel along longitudinal lower slot portion 75, and relative rotation is effected as necessary between the mandrel portion 15 and tubular sub 25a so that the lugs 52 move over so they can continue to travel along in longitudinal slot portion 73. Relative rotation is again effected between lower mandrel portion 15 and tubular sub 25a if necessary to move the lugs 52 out of slot portion 73 and engage the lugs 52 with a shoulder surface such as represented at 74a, in the upper slot portion 74. The mandrel M and member 25 are then rotated together so mandrel lower tubular portion 15 threadedly engages with mandrel upper tubular portion 14 by the cooperating threads 44.

Relative rotation and movement between mandrel lower tubular portion and member lower sub 25a is effected to move lugs 52 back through slot 73 and to adjacent or engaged with a shoulder, such as represented at 75a, on slot portion 75 as shown in the drawings. Where the upper sub or member 72 as in the FIG. 9 embodiment is omitted, either of the above procedures may be followed to connect lower tubular portion 15 of the mandrel with mandrel upper tubular portion 14.

Body B is then moved toward the upper end of the mandrel M along mandrel M and when the resilient element 55 is used, such movement collapses the resilient element 55 between shoulder 35a of the mandrel sub and shoulder 56 on body B as shown in FIG. 1A and suitable frangible means such as shear pins 32 are positioned through an opening in the body B to extend into a recess in mandrel sub 31, to releasably secure the body B to the mandrel with the resilient element maintained in collapsed position between shoulder 56 and shoulder 35a as shown in FIG. 1A. As previously noted frangible means of any suitable well known form may be employed to secure the body B to the mandrel, and the exact position of securing the body B on the mandrel may be varied within operating limits.

The positioning of lugs 52 adjacent or engaged with slot shoulder or surface 75a on member 25 places all components of the tool part of the invention in position to cooperate for setting of the packer when the packer is placed in the opening in which the packer is to be set without further tool manipulation.

If the form of FIGS. 7 or 8 is employed then either of the procedures as above stated is followed except the resilient member 55 is omitted from body B. If desired, the drag blocks 70 and tubular member 72 may be omitted.

If the form of FIG. 9 is employed then either of the above stated procedures is followed, except the drag blocks 70, and tubular member 72 are omitted.

The tool part of the invention is then connected with the wireline pressure setting assembly W, as previously described, and lowered into the well bore. The shear pins 40 or 47 securing the assembly W with the tool form of the present invention will be stronger so as to shear last in the operation of the tool and assembly W. The shear pins 72*a* securing member 25 to sleeve 60 will be next strongest to maintain the drag blocks retracted, or to maintain member 25 in position in the FIG. 9 form, and the shear pins 32 will be the first to be sheared so that body B can move along mandrel and cooperate with the other tool components and set the packer.

In the operation of the present invention it is releasably secured with the wireline pressure setting assembly W by the arrangement of FIGS. 4, 5, or 5A and lowered into the well bore on a wireline in a manner well known in the art and positioned in the opening formed by a tubular member or at the desired location in the well bore. The pressure setting assembly is actuated in a manner well known in the art and this moves the outer sleeve 18 down to move body B which shears shear pins 32 and releases body B for movement by the outer sleeve 18 on the mandrel M to engage slips 57 thereon with the tapered surface 58*a* on the packer support 26.

The packer support 26 including support sleeve 27 moves down when the upper slips 57 contact surface 58*a* on the packer support 26. Downward movement of the support sleeve 27 shears pins 72*a* to release the member 25 and the drag block springs 71 in the FIGS. 1A and 1B form. In the FIGS. 7, 8, and 9 embodiment only the member 25 is released since no drag block body 72 or drag blocks are employed. Second end portion 60 of the packer support 26 contacts lower slips 62 to force the lower slips 62 and tapered surface 61 out into securing engagement with the surface defining the opening in which the present invention is positioned. This stops the downward movement of movable portion 60 of the packer support 26. Continued downward force by the outer sleeve 18 of the assembly W, on body B and packer support 26 forces packer support 26, packer P and support sleeve 27 down. Packer P is thus forced against packer support second end portion 60 which forces or extends the packer or seal elements P out into sealing engagement with the surface defining the opening in which the present invention is positioned. The above action continues until the packer P and the upper slip and cone anchor assembly is firmly engaged with the surface in the tubular member or in open hole which surrounds the opening in which the packer is placed. The foregoing motion causes a relatively short longitudinal movement of the components supported on the mandrel.

After the packer P is set, the outer sleeve 18 of assembly W continues to exert force and this causes a reaction to shear the pins 47 in the FIG. 4 form of releasable connection between the tool part of the present invention and the assembly W or shear the pins 40 in the FIG. 5, 5A form to release the wire line pressure setting assembly W from its connection with the stinger 30 on the mandrel M as shown in FIGS. 4, 5, 5A and 5B., so that it may be retrieved to the earth's surface.

When it is desired to retrieve the packer tool part including packer P of the present invention from the well bore, a well string such as a tubing string WS with the overshot 80 thereon, as shown in the upper part of FIG. 6, which has a J slot 81 is lowered into the well bore and the well string WS is manipulated to engage the lugs 30*h* on the stinger 30, shown in the lower part of FIG. 6, into the J slot 81 on the overshot shown in FIG. 6 to secure the overshot therewith. Thereupon, the mandrel M is lowered and rotated by the well string relative to the member 25 which is restrained from rotation by the engagement of the lower slips 62 with the surface 61 and with the surrounding surface of the tubular member or open hole in which the packer P is set. Rotation and lowering of the mandrel M moves the lugs 52 on the mandrel M out of slot portion 75 into main longitudinal slot 73. The well string WS and mandrel M are then lifted which moves the lugs 52 up slot 73. This movement lifts the shoulder 35 on mandrel sub 31 up to engage shoulder 34 on body B and continued lifting of the well string disengages the top slips 57 from surface 58*a*. Continued lifting of mandrel M by the well string engages the shoulder 77 on the mandrel with end cap 69 on support sleeve 27 and moves the support sleeve 27 and mandrel M up to contact annular shoulder 67 on support sleeve 27 with annular shoulder 68 on movable packer support portion 60 and this moves the movable portion 60 and lower cone surface 61 thereon up and away from lower slips 62. The upward lifting force on the mandrel by the well string WS string automatically shifts the lugs 52 on the mandrel from the slot 73 to the top slot portion 74 of member 25. The packer and well string may then be retrieved to the earth's surface by removing the well string from the well bore.

The lugs 52 on the mandrel and the shoulder 75*a* in the lower J slot portion 75*a* of the member 25 provide surfaces on the mandrel and member engageable to set the packer by the assembly W when the packer is positioned in the opening without further tool manipulation and then serve as a lock to maintain the packer P set until the lug 52 is moved out of slot 75 to slot portion 74 by manipulating the mandrel with the well string. The lugs 52 and the slot portion 74 provide additional surfaces on the mandrel and member to effect release of the packer P, when desired, for retrieval by manipulating the mandrel to move the lugs from the lower slot portion 75 to the upper slot portion 74.

Seals 82 may be provided on the interior surface of washover 80 for sealably engaging the washover with the stinger 30 when the washover is telescoped over the stinger 30 at the upper end of the mandrel M. When the washover and stinger are thus positioned the packer on the tool functions as a production packer for flow through the bore 26*a*.

Figure 10:
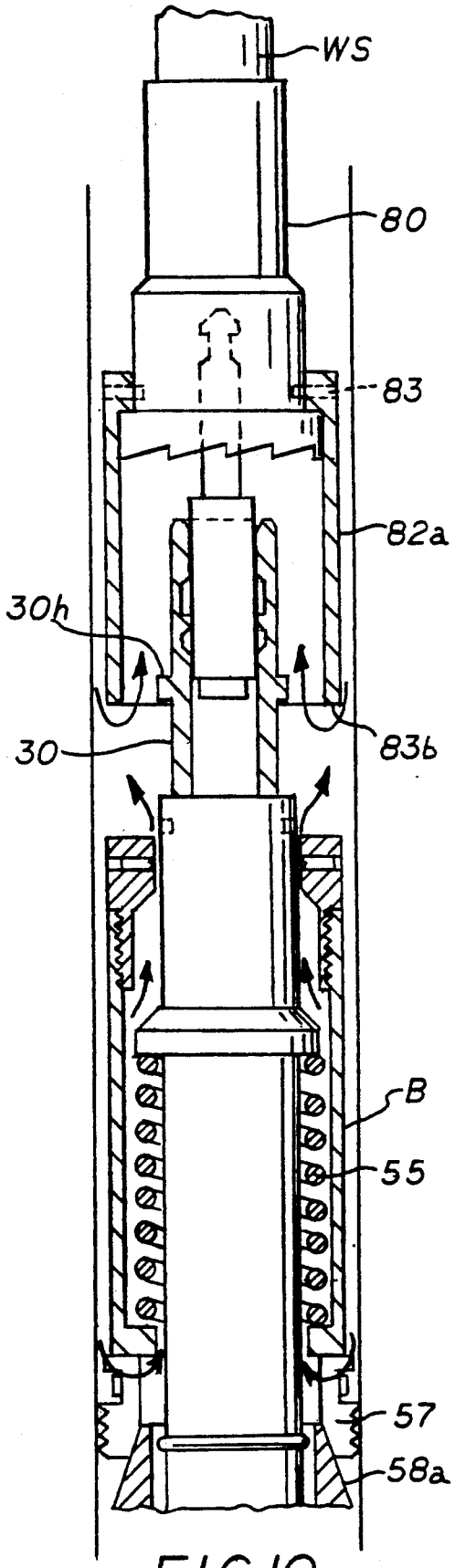
FIG. 10 illustrates one form of the retriever part of the present invention.

FIGS. 10 and 15 show other forms of a retriever used with the present invention. The overshot 80 of FIGS. 10 and 15 has a J slot 81, not shown, that is formed only on the interior surface of the overshot.

FIG. 10 illustrates an another form of retriever of the present invention. In some instances sand is poured in a well bore on top of a packer to protect the packer from metal debris that may be present in a well bore over a period of time. In other situations, debris may collect and settle on top of the packer and tool set in a tubular member so that is is difficult, and in some instances, impossible to retrieve in a normal manner so that it can only be drilled out. The present invention incorporates a retriever which can be employed to remove the debris, engage with the packer tool and remove it and any seal bore assembly or auxiliary equipment associated with the packer in a single round trip into and out of the well bore. Heretofore, such operations have required use of a workover rig with multiple trips into and out of the well bore, which increase the cost and may, particularly in older fields be impractical for economic reasons.

In this form of retriever the overshot 80 is provided with a skirt 82*a* releasably secured thereto by shear pins 83 and terminating in lower end 83*b*. The retriever is shown as having been lowered on well string WS to position it adjacent the tool part of present invention set in the opening in a tubular member in a well bore. When the retriever is in position as shown in FIG. 10, and when conditions in the well bore warrant it, fluid is reverse circulated in the well bore down the casing C, outside around the well string WS and the retriever connected thereto and circulated back up through the retriever and the well string WS as indicated by the arrows in FIG. 10. If desired, a junk retriever may also be employed to trap heavy junk that cannot be circulated with the fluid through the well string to the earth's surface. Circulation is continued as the well string is lowered to thoroughly wash around the upper end of the mandrel M including stinger 30, body B and resilient element 55 in body B, and upper slips and cones as indicated by the arrows in FIG. 10. Contact of the lower end 83*b* of the skirt 82*a* with the top of body B will be reflected on the weight indicator at the earth's surface. Lowering is continued until shear pins 83 are sheared.

When this occurs, the overshot 80 is lowered through the skirt 82*a* and manipulated by the well string WS to engage the J slot therein with the lugs 30*h* on the stinger. Manipulation, rotation and lifting the well string WS in a manner well known rotates and lifts mandrel M to move lugs 52 to the top of the J slot as previously described and continued upward movement of the tubing string releases the upper slips and cones and the lower slips and cones from the tubular member so the tool part of this invention may be retrieved to the earth's surface.

FIGS. 7 and 8 show another form of the tool part of the present invention wherein the resilient element 55 is omitted from the body B of the present invention. FIG. 8 shows a friction resistant bearing 84 to assist in reducing the tendency of binding between the annular projection 87 on the mandrel M and adjacent metal components as the mandrel is lowered to unset the packer as will be described. The annular projection 87 is somewhat larger in FIG. 8 than it is is in FIG. 7.

Where the packer is not to be released and reset in the well bore, the drag block support 72 and drag blocks 70 are omitted as shown in the FIG. 9 embodiment. The body B may be employed with the resilient element, or the resilient element may be omitted.

Figure 11:
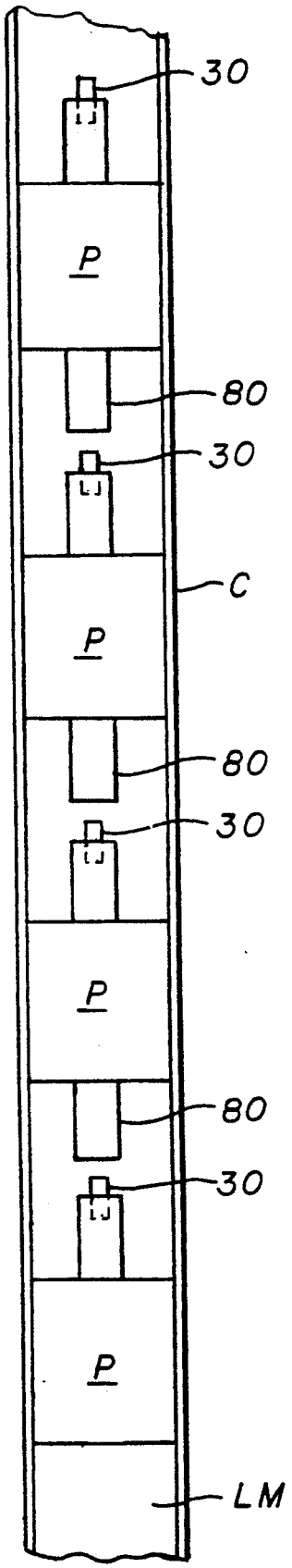
FIG. 11 is a diagrammatic illustration of a manner of isolating an indeterminate number of zones in a cased or open well bore by the present invention and schematically showing the packers in position after single trip setting and in position for single trip recovery of an indeterminate number of packers from a well bore by the present invention.
Figure 12:
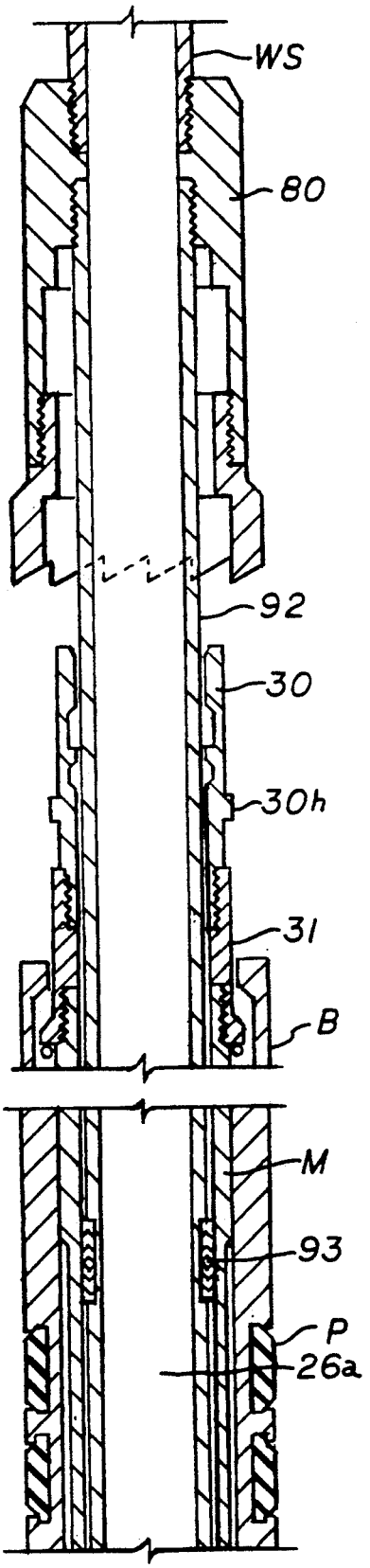
FIG. 12 illustrates an alternate form of retriever with a seal bore assembly.

FIG. 11 is a diagrammatic representation of the use of the present invention for isolating zones in a well for testing and treating, if desired. In conducting tests on a well bore at the present time, it is generally accepted practice to test and/or treat the lowermost zone, designated LM, first. Generally, the zone to be tested is perforated and a bridge plug and a test packer are then lowered into the well bore, ordinarily on a tubing string. The bridge plug and test packer are spaced longitudinally on the well string so the bridge plug is set below the perforated zone in the well and the packer is set above the perforated zone in the well on a tubing string. Flow and pressure tests are conducted in an ordinary manner well known to those skilled in the art, and if desired various treating operations may be performed. The procedure of isolating and testing each desired zone is stepwise repeated throughout the desired extent of the well bore by releasing the packer and bridge plug from set position at the lowermost zone and then resetting them and unsetting them at each of the next higher zones in the well. However, releasing and resetting the packers involves some exposure in that if the packers fail to set properly, or if they malfunction for any reason during the plural expansion, releasing and then resetting operations, the tubing string is removed and repair or replacement operations conducted, and the tubing string and packers then rerun into the well bore.

FIG. 11 illustrates the manner in which the present invention may be employed to overcome the above potential problems. The lowermost zone LM in the well bore is perforated by a casing gun on a wireline in a manner well known in the art. The present invention with a removable plug 30*c* as shown in FIG. 5 in a stinger 30 is shown schematically in FIG. 10 as connected to and extends upwardly from mandrel M of the present invention which is lowered on a wireline with a pressure setting assembly attached and the packer is set above the lower most zone LM. The wireline setting assembly is removed from the well bore on the wireline after the packer is set. Plug 30*c* is removed from the stinger by a slick line to enable the flow rate and pressure of the zone below the packer to be tested in a well known manner through the casing. The plug 30*c* is then repositioned in the stinger 30 by a slick line.

The next higher well bore zone to be tested is perforated as above stated, and then another wireline packer tool of the present invention is lowered into the well bore on a wireline and set above the zone. A removable plug 30*c* is provided in a stinger 30 extending upwardly from the mandrel and a washover 80 is connected to the mandrel lower end to depend therefrom as illustrated schematically at 80 in FIG. 10. The plug 30*c* is retrieved with a wireline from the stinger and the flow rate and pressure is tested through the casing in a manner well known. The plug 30*c* is repositioned in the stinger by a slick line.

All other zones to be isolated and tested are each stepwise subjected to the same procedure as above stated. If desired, the well may then be shut in by a manner well known in the art.

If one or more zones are to be treated after testing, a well string, such as a tubing is lowered with an overshot 80 and connected to the stinger 30 extending up from the mandrel M. The plug 30*c* is removed from the stinger by a slick line through the tubing and treating operations conducted though the tubing. The plug 30*c* is then repositioned in the mandrel of the packer by a slick line, and the tubing is removed and the next zone isloated and tested as above described.

This procedure is followed until all desired zones have been isolated and tested and also treated if desired. Each packer is provided with a stinger 30 on the upper end of the mandrel and a washover 80 on the lower end of the mandrel, except the lowermost packer, which has only the stinger 30 extending upwardly as illustrated in FIG. 11 of the drawings.

All packers may then be retrieved in a single trip of the tubing by manipulating the well string or tubing to engage the top, or uppermost stinger 30 with an overshot 80 on the tubing string. The top plug 30c is then engaged by a slick line and removed to the earth s surface. The tubing string is manipulated to move the lugs 52 in the J slot to unset the packer from set position in a manner well known. The tubing and the engaged unset packer with an washover 80 depending from the lower end of the mandrel of the unset packer is lowered to engage the upwardly extending stinger 30 on the next lowest packer in the well bore. The plug 30c is retrieved as above explained, and the packer is unset and latched to the overshot 80 depending from the first unset packer on the tubing as above explained. The above procedure is stepwise repeated until all the packers are secured on the tubing string whereupon it can be removed to the earth's surface with all packers in a single trip.

Figure 13:
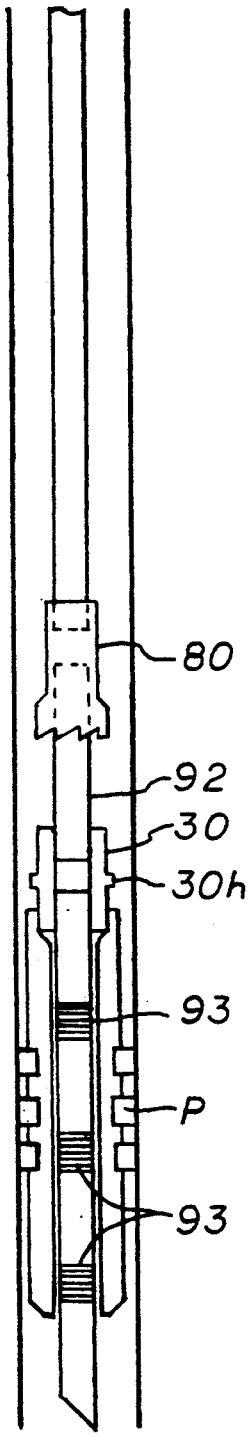
FIG. 13 is a schematic of the arrangement of FIG. 15 when in set position.
Figure 14:
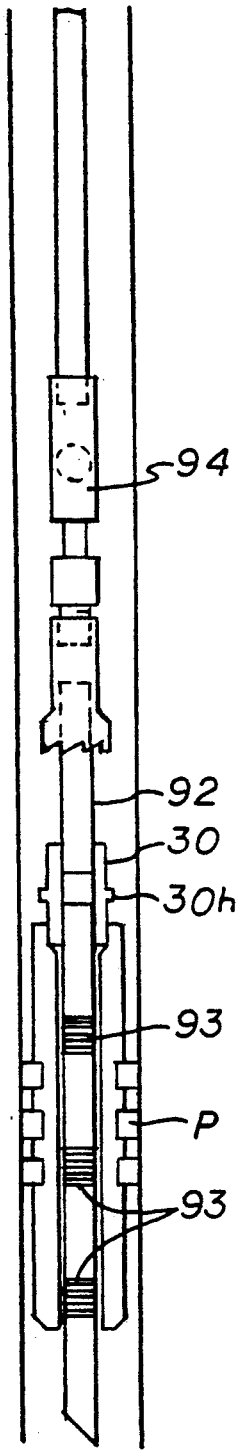
FIG. 14 is a schematic similar to FIG. 16 with a tubing tester added.

FIGS. 13 and 14 illustrate a retriever which can function with the tool part of the present invention as a flow or treating tool and recover the equipment associated with the packer in flowing or treating and the packer in a single trip into and out of the well bore. A well string WS is connected to a washover 80 similar to that described with regard to FIG. 10, with or without skirt 82a. A seal bore assembly including tubular extension 92 of smaller external diameter than the internal diameter of the bore 26a in mandrel M is connected with the washover 80 in any suitable manner as shown in FIG. 13 for extending into the mandrel bore 26a when the washover 80 is lowered as shown in FIG. 13 and engaged with the stinger 30. Suitable seals 93 are provided on the exterior of the tubular extension for sealably engaging with the mandrel bore 26a. The washover 80 can be connected to the mandrel M by engaging with the lugs 30h on stinger 30 to secure the well string WS to the set packer. Treating operations may be conducted through the well string WS, tubular extension 92 and the set packer P or the well may be flowed through the tubular extension.

When it is desired to retrieve the set packer, the well string is manipulated to unset the packer as above described and the auxiliary equipment associated with the packer as shown in FIGS. 13 and 14 is recovered along with the packer in a single trip from the well bore. FIG. 14 shows the arrangement of FIG. 13 with the packer P set and FIG. 14 shows the arrangement of FIG. 13 with a tubing tester 94 connected in the well string above the overshot. FIGS. 7 and 8 show only the upper part of the embodiment, but it can be appreciated that the remainder of the packer tool is as shown in FIG. 1B, and the packer embodiment of FIGS. 7 and 8 may be used with the overshot 80 and washover arrangement of FIG. 10 or other modifications and described or illustrated. FIG. 9 shows only the lower portion of the embodiment which omits the upper sub or member 72 of the member, but it also is used with the upper part of the packer tool as shown in the drawings and described and with the other variations.

The J slot on the member 25 and the lugs 52 on the mandrel M enable the present invention to be readily converted for use with a well string when desired. One form for use with a well string is by threadedly connecting the well string to the stinger, or with an overshot 80 which is then connected with the lugs on the stinger or threadedly engaged to mandrel upper end so that the mandrel can be manipulated for operating the packer tool to set it and release it.

The foregoing is by way of example only, and changes can be made without departing from the scope of the invention which is more properly encompassed by the following claims.

What is claimed is:

1. A wireline set packer tool for use with a wireline pressure setting assembly to engage and releasably secure a packer with the surface which defines an opening in a well bore, the wireline set packer tool including:

a mandrel;

said mandrel having a longitudinal bore therein and an upper and a lower end;

a packer support on said mandrel;

a packer on said packer support;

said packer support having an upper end;

said packer support having a lower end;

said packer support lower end including an end portion movable relative to said packer support to expand and engage the packer with the surface which defines the opening in the well bore;

a spring support body on said mandrel;

said spring support body having a lower end;

a collapsed spring supported by said spring support body;

a frangible member releasably securing said spring support body with said collapsed spring thereon on said mandrel;

a member surrounding a portion of said mandrel;

said member having an upper end adjacent said packer support movable end portion;

said member having a lower end;

a J slot on said member having longitudinally extending main slot portion communicating with a circumferentially offset slot portion at each end of said main slot portion to provide upper and lower slot portions on said member;

lug means on said mandrel in said lower slot portion on said member; and first cooperating surfaces on said upper end of said packer support and on said lower end of said spring support body and second cooperating surfaces on said lower movable end portion of said packer support and on said upper end of said member to releasably secure said packer engaged with the surface defining the opening in the well bore.

2. The wireline set packer tool of claim 1 wherein:

said first cooperating surfaces comprise annular tapered surfaces on said upper end of said packer support and on said lower end of said spring support body;

said second cooperating surfaces comprise annular tapered surfaces on said lower movable end portion of said packer support and on said upper end of said member, and;

means releasably maintaining said packer support spaced between said spring support body and said member.

3. The wireline set packer tool of claim 1 including a releasable connection connecting the wireline set packer tool with the wireline pressure setting assembly.

4. The wireline set packer tool of claim 3 wherein said releasable connection connects said mandrel of the wireline set packer tool with the wireline pressure setting assembly.

5. The wireline set packer tool of claim 1 wherein the packer tool may be engaged, secured and released at selected positions with the surface defining the opening in the well bore and includes:

a support sleeve secured with said packer support and depending therefrom;

said member surrounding a portion of said support sleeve;

drag blocks supported on said member;

spring means urging said drag blocks outwardly toward the surface defining the opening in the well bore; and shear means engaging said drag blocks, spring means and said member with said support sleeve to maintain said drag blocks in inoperative position.

6. The wireline set packer tool of claim 1 wherein said first cooperating surfaces are slip means on said lower end of said spring support body and an annular tapered surface on said upper end of said packer support, and said second cooperating surfaces are slip means on said upper end of said member and an annular tapered surface on said lower movable end portion of said packer support.

7. The packer tool of claim 1 wherein projection means are adjacent said mandrel upper end and including a retriever for lowering in the well bore on a well string for connecting with said mandrel, said retriever including:

a washover for connecting with the well string;

a skirt releasably secured to said washover and depending therefrom; and said washover having slot means therein for releasably engaging said projection means on said mandrel to manipulate said mandrel by the well string and retrieve the tool, washover and skirt from the well bore in a single trip.

8. The wireline set packer tool of claim 1 wherein said lower slot portion has an open lower end at said lower end of said member.

9. The wireline set packer tool of claim 1 wherein said mandrel includes a tubular washover depending from said lower bore end of said mandrel.

10. The wireline set packer tool of claim 1 wherein said mandrel includes a tubular stinger extending from adjacent said upper bore end of said mandrel, and lugs projecting outwardly on said stinger.

11. The wireline set packer tool of claim 1 including a plug for blocking flow through said longitudinal bore.

12. The wireline set packer tool of claim 11 wherein said plug is removably positioned adjacent the lower end of said mandrel.

13. The wireline set packer tool of claim 11 wherein said plug is removably positioned adjacent the upper end of said mandrel.

14. The wireline set packer tool of claim 1 including connecting means for connecting said member releasably to said packer support.

15. The wireline set packer tool of claim 1 wherein said collapsed spring is between said spring support body and said mandrel.

16. A method of positioning and securing the packer of a wireline set packer tool and slip and cone anchor assembly with the surface that defines an opening in a well bore by actuating a wireline pressure setting assembly releasably connected to the wireline set packer tool that includes a mandrel, a body with a collapsed resilient element thereon releasably secured on the mandrel and movable on the mandrel in response to actuation of the pressure setting assembly, a member partially surrounding the mandrel, a packer on a packer support between the body and the member, the packer support having an upper end for engagement by the body and a lower end for engagement by the partially surrounding member when the pressure setting assembly is actuated, comprising the steps of:

lowering the wireline set packer tool and pressure setting assembly into and positioning the wireline set packer tool in the opening in the well bore;

actuating the pressure setting assembly to release the body from the mandrel and move the body on the mandrel to engage the packer support between the body and the member to extend the packer and the slip and cone anchor assembly into sealing and securing relationship with the surface that defines the opening without further manipulation of the wireline set packer tool and to release the pressure setting assembly from the wireline set packer tool; and maintaining the resilient element at least partially collapsed as the body moves on the mandrel.

17. For use with a wireline pressure setting assembly to position a packer in sealing engagement in a well bore tubular member and retrieving the packer from the well bore, a wireline set packer tool including:

packer seal elements;

a packer support for said packer seal elements;

a mandrel for supporting said packer support;

said mandrel having a longitudinal bore therein with an upper and a lower end;

projection means adjacent said mandrel upper end;

a member on said mandrel;

surfaces on said member and mandrel holding said member on said mandrel as said member and mandrel are positioned in the well bore tubular member for setting of the packer by the wireline pressure setting assembly;

said surfaces on said member and said mandrel including a J slot on said member having a longitudinally extending main slot portion communicating with circumferentially offset upper and lower slot portions at each end of said main slot portion to provide upper and lower slot portions on said member;

lug means on said mandrel in said lower slot portion on said member;

a retriever for lowering in the well bore on a well string for connecting with said mandrel;

said retriever including:

a washover for connecting with the well string;

a tubular extension secured with an depending below said washover for telescopically extending within said mandrel bore;

said tubular extension having seals thereon for sealably engaging with said mandrel bore; and said washover having slot means thereon for releasably engaging with said projection means on said mandrel to manipulate said mandrel by the well string and retrieve the wireline set packer tool, washover and tubular extension from the well bore in a single trip.

18. A method of assemblying a wireline set packer tool wherein the wireline set packer tool includes a mandrel formed by threadedly connected upper and lower mandrel tubular portions the upper mandrel tubular portion releasably supporting a spring support body with a collapsed spring thereon, a packer support with a packer thereon and a member that surrounds a portion of the upper mandrel tubular portion, the member having a J slot therein formed with a longitudinally extending main slot portion communicating with a circumferentially offset slot portion at each end of said main slot portion to provide upper and lower slot portions on said member with the lower slot portion having a lower open end at the lower end of said member and the lower mandrel tubular portion having lugs thereon comprising the steps of:

releasably securing the spring support body with the collapsed spring thereon on the upper mandrel tubular portion;

positioning the packer support on the upper mandrel tubular portion;

positioning the member on the upper mandrel tubular portion;

aligning the lugs on the lower mandrel tubular portion with the lower open end slot in the lower end of the member;

manipulating the lower mandrel tubular portion to position the lugs thereon in the lower slot portion and to position the lower mandrel tubular portion to threadedly connect it with the upper mandrel tubular portion; and rotating the lower tubular mandrel portion and member to connect the mandrel lower tubular portion with the mandrel upper tubular portion.

19. A wireline set packer tool including:

a mandrel;

a spring support body on said mandrel;

a collapsed spring on said spring support body;

a frangible member releasably supporting said spring support body with said collapsed spring thereon on said mandrel;

a member partially surrounding said mandrel; and a packer support with a packer thereon on said mandrel between said spring support body and said member.

* * * * *